United States Patent [19]

Thibeault

[11] 4,039,235

[45] Aug. 2, 1977

[54] ELECTRICAL RECEPTACLE

[75] Inventor: Ronald N. Thibeault, Buena Park, Calif.

[73] Assignee: Sola Basic Industries, Inc., Milwaukee, Wis.

[21] Appl. No.: 651,857

[22] Filed: Jan. 23, 1976

[51] Int. Cl.[2] ..... H01R 3/06; H01R 11/20; H01R 13/66

[52] U.S. Cl. ..... 339/14 R; 174/53; 339/95 D

[58] Field of Search ..... 339/14 R, 95 R, 95 D, 339/132 B, 133 R; 174/53-56

[56] References Cited

U.S. PATENT DOCUMENTS

| | | | |
|---|---|---|---|
| 3,723,942 | 3/1973 | Dennison | 339/14 R |
| 3,786,399 | 1/1974 | McHattie | 339/14 R |
| 3,868,161 | 2/1975 | Frantz | 339/14 R |

*Primary Examiner*—Roy Lake
*Assistant Examiner*—E. F. Desmond
*Attorney, Agent, or Firm*—Blakely, Sokoloff, Taylor & Zafman

[57] ABSTRACT

An electrical receptacle having a body with upper and lower molded plastic portions with a grounding strip located in a cavity therebetween, the lower portion having extending mounting strap ears and the grounding strip having a connection extending under one of said ears for making contact with a holding screw, said grounding strip also having a visible connection tab.

8 Claims, 12 Drawing Figures

FIG. 1
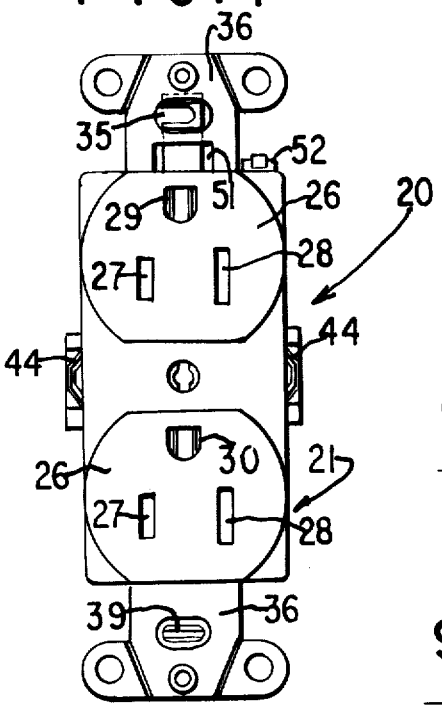
FIG. 3
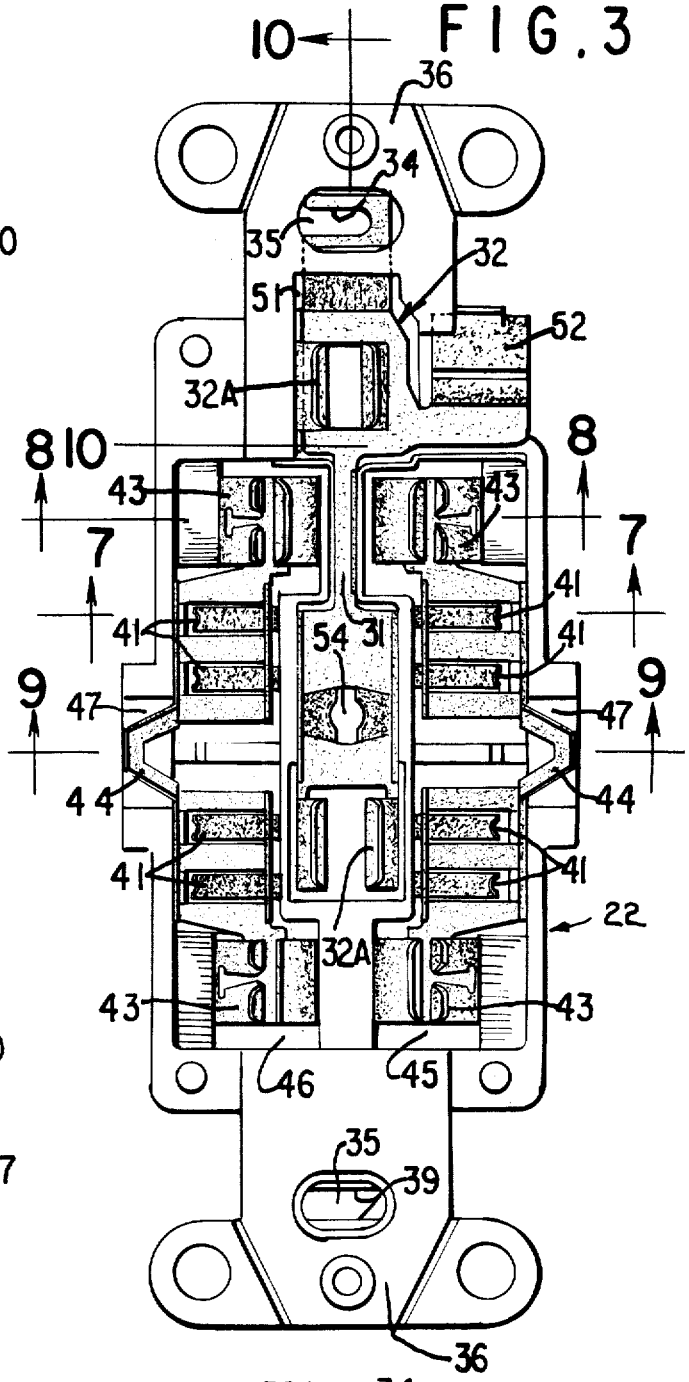
FIG. 2
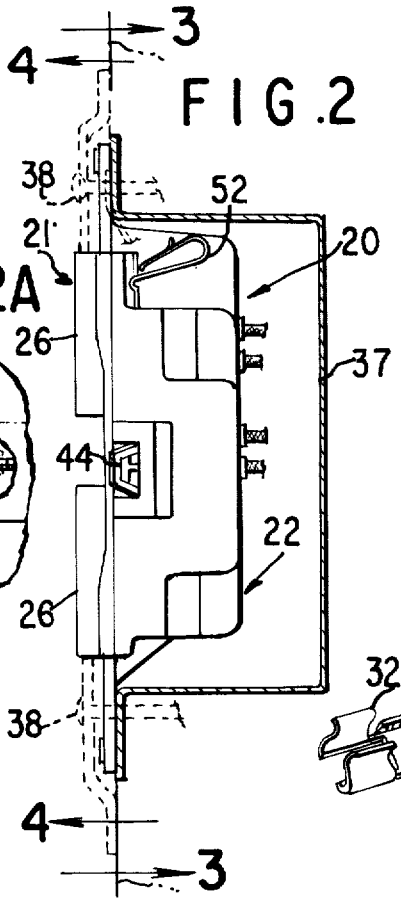
FIG. 2A
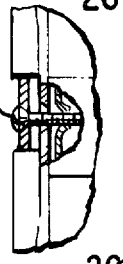
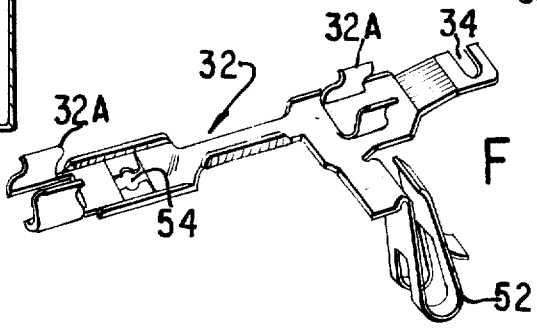
FIG. 5

FIG. 4
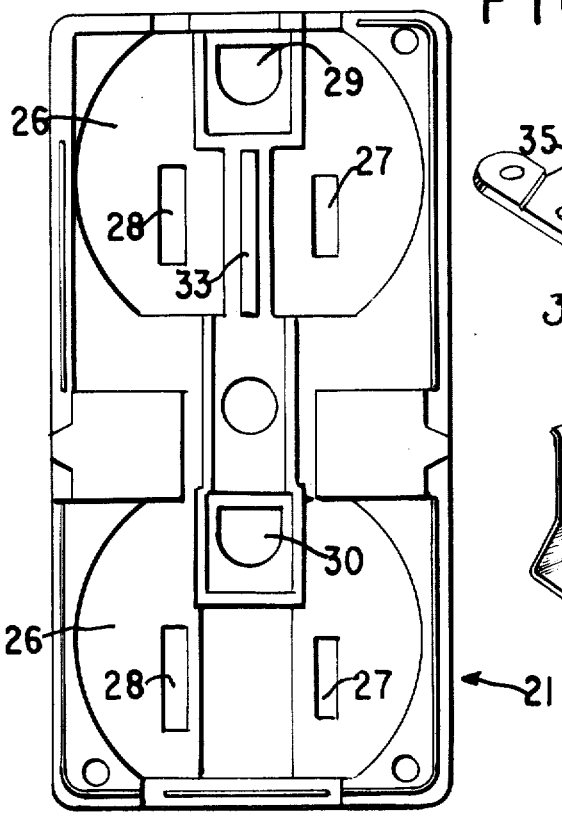
FIG. 11
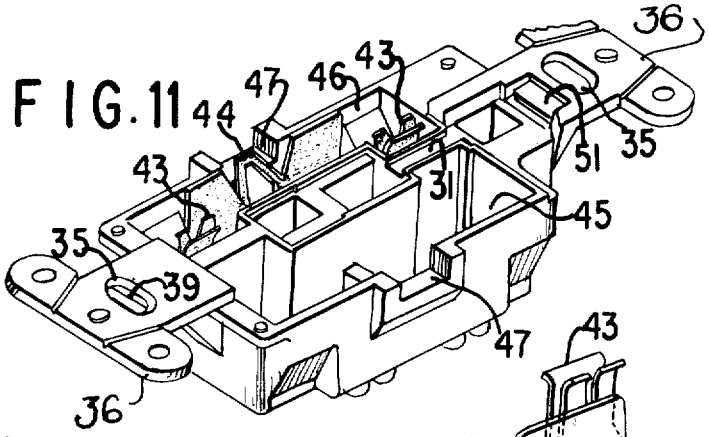
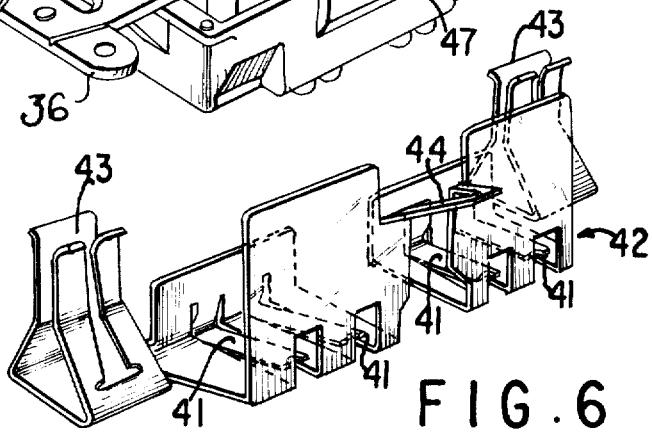
FIG. 6
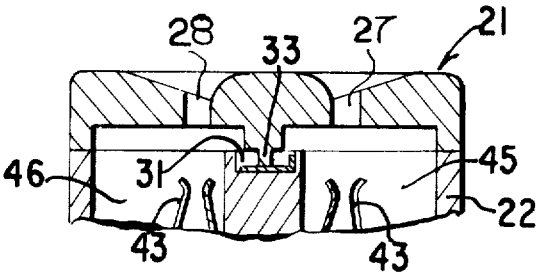
FIG. 8
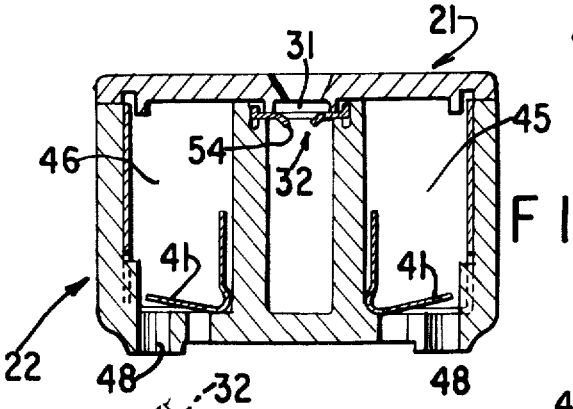
FIG. 7
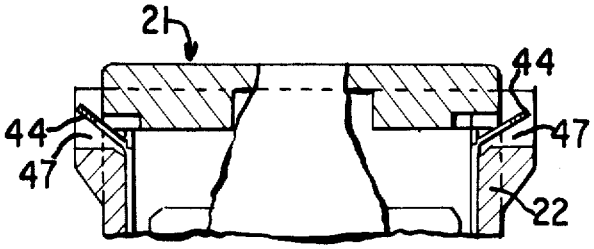
FIG. 9
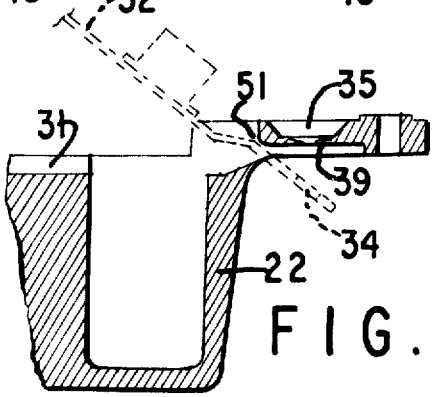
FIG. 10

ELECTRICAL RECEPTACLE

This invention relates to electrical outlet receptacles and especially safety grounding connections thereof.

It is old in the art to provide grounding connections for convenience outlet electrical receptacles, such as those of the wall and similar types which accommodate wiring attachment plugs which include a grounding blade. Conventional grounded outlet boxes mounted in apertures in the wall have had outlet receptacles mounted therein in such a manner as to have a metal-to-metal contact of the metallic mounting strap and the grounded wall box, such as shown in U.S. Pat. No. 3,885,847. Also, provisions have been made in some for a separate wire connecting the grounded circuit of the receptacle and the grounded outlet box. It is desirable to provide an assembly having a minimum of parts which can be efficiently manufactured and assembled.

One of the objects of the invention is to provide an improved receptacle which can be efficaceously manufactured, assembled and installed.

In one aspect of the invention, the receptacle has a body of non-conductive material, such as a molded plastic, in which a receptor means is mounted for receiving the contact blades or stabs of a wire attachment plug. The body can comprise an upper and lower portion with a cavity therebetween for holding a grounding strip, the lower portion of the body having integral mounting strap ears. The grounding strip has an extension which overlies one of the ears and through which a metal screw for holding the receptacle in place in a wall type outlet box passes which also serves to ground the same. Additionally, the grounding strip has an extension in a passageway to the outside of the body to which a grounding jumper wire can be fastened if desired. The term "upper" and "lower" portion refer to the relation of the body portion regardless of the position in which the assembly may be mounted These and other objects, advantages and features of the invention will become apparent from the following description and drawings, which are merely exemplary.

In the drawings:

FIG. 1 is a plan front view of an assembled duplex receptacle;

FIG. 2 is a side view of FIG. 1;

FIG. 2A is a fragmentary view showing a manner of mounting and grounding the face plate to the receptacle and to the grounding strip;

FIG. 3 is an enlarged view along the line 3—3 of FIG. 2 showing the lower portion of the receptacle body;

FIG. 4 is an enlarged view along the line 4—4 of FIG. 2 looking from the bottom of the upper or cover portion of the receptacle which fits onto the lower portion shown in FIG. 3;

FIG. 5 is a perspective view of the grounding strip of the present invention;

FIG. 6 is a perspective view of one form of service wire connector and the contact elements thereof;

FIG. 7 is a sectional view taken along the line 7—7 of FIG. 3;

FIG. 8 is a fragmentary sectional view taken along the line 8—8 of FIG. 3;

FIG. 9 is a broken fragmentary sectional view taken along the line 9—9 of FIG. 3;

FIG. 10 is a fragmentary longitudinal view taken along the line 10—10 of FIG. 3 showing the manner in which the grounding strip is assembled to the lower portion of the body; and FIG. 11 is a perspective view of the lower portion of the body.

Where appropriate, the same reference numerals will be used in the various figures to identify the same or similar parts.

Referring now to FIG. 1, assembly 20 depicts a duplex or two-plug receptacle but the invention can be applied to receptacles with provisions for more or less numbers of plugs.

The assembly body, which preferably is of a non-conductive material, such as a molded plastic, can be composed of an upper or cover portion 21 and a lower portion 22. The upper portion has conventional outlets 26 with apertures 27, 28 for receiving the contact blades or stabs of wiring or attachment plugs. Apertures 29, 30 are provided for the ground contact blades or stabs of a wiring attachment plug as is known in the art.

The upper and lower body portions 21, 22 have a cavity 31 (FIGS. 3, 7, 8, 11) for receiving a separate grounding strip 32 therein. Grounding strip 32 has ground plug engaging contact means 32A. In the form shown, cavity 31 is located in the lower portion 22 of the body and the upper portion has a rib 33 (FIGS. 4, 8) for holding the grounding strip in assembled relation when the upper and lower portions are joined or fitted together.

The grounding strip 32 has an extension 34 with screw-engaging means underlying one of the apertures 35 in the mounting yoke or ears 36 of the mounting strap which are parts of the lower portion 22. The mounting yoke can be integrally molded with the lower portion 22.

The receptacle can be mounted in a conventional grounded wall box 37 (FIG. 2) by metal screws 38 which are in electrical contact with the grounding strip extension 34 so as to provide a self-ground connection.

Screws 38 can be captivated in the apertures 35 in the mounting yoke or ears 36 by means of a bevelled lip 39 (FIG. 10), such as described in detail in copending application Ser. No. 553,679, filed Feb. 27, 1975 now U.S. Pat. No. 3,967,049.

In the form shown, the receptor or contact blade means for receiving the attachment plug blades can be formed from a single piece of metal as seen in FIG. 6. Bendable tongue push wire connectors 41 are integrally formed in U-shaped metal wire receiving elements or means 42. The receptor contact blades 43 are formed at the outside ends of the U-shaped metal elements 42. Elements 42 are joined in the center by a connecting strip 44.

Each assembly of elements can be dropped into place in its cavity 45, 46 (FIGS. 6, 11), the strip 44 extending through aperture 47. If it is desired to separate the receptors into two circuits, strip 44 can be cut or removed.

In connecting service wires to the receptacle, a wire can be pushed into an aperture 48 (FIG. 7) so as to bend the tongue inwardly. Then upon pulling the wire outwardly, the tongue will grip the wire and make a connection therewith. In order to thereafter remove the wire, the wire can be pushed inwardly again to disengage the tongue and then the tongue held inwardly as the wire is pulled out. By the structure shown, eight conductors can be connected to the receptacle in various desired configurations. An example of push wire connectors is shown in U.S. Pat. No. 3,327,277. Such types of connectors per se are known in the art.

After assembling the wire connector elements into their respective cavities 45, 46, grounding strip 32 is threaded through aperture 51 as seen in FIGS. 10 and 11 and then dropped into place into its cavity 31 in lower portion 22. The cover plate 21 is then put into position on top of lower portion 22 and the parts can be sealed or fastened together in a desired manner such as by ultrasonic welding techniques.

After the receptacle is assembled, it can be placed into its wall outlet box and secured thereto by screws 38. If desired, a separate ground wire can be fastened to the pressure lock 52 of the grounding strip 32. After assembly, a conventional face plate can be placed over the receptacle and fastened thereto by a screw 53 (FIG. 2A) threaded into aperture 54 of the grounding strip which also will ground the wall plate.

It can be seen that the receptacle assembly comprises only five parts, namely, upper cover 21, lower portion 22, contact element assemblies 42, 43, and grounding strip 32. The combination has parts that can be easily formed and assembled into a final receptacle.

It should be apparent that details of construction can be varied without departing from the spirit of the invention except as defined in the appended claims.

What is claimed is:

1. An electrical receptacle having a body with electrical receptor means therein, said body having nonconductive upper and lower portions, said lower portion having mounting strap means integral therewith and extending longitudinally therefrom and the upper portion having apertures corresponding to said receptor means and through which connector blade means can be removably inserted, there being a cavity between said upper portion and lower portion for receiving a grounding strip, and grounding strip means in said cavity, said grounding strip having aperture means for receiving grounding blade means of said connector blade means, said strip having an extension from said cavity to the exterior of said upper and lower portion for receiving a ground connection, and having a portion under said mounting strap means which can be contactable by a receptacle mounting screw.

2. An electrical receptacle as claimed in claim 1 wherein said extension of the grounding strip means is a pressure lock means.

3. An electrical receptacle as claimed in claim 1 wherein said mounting strap means has bevelled apertures for captivating said mounting screw therein.

4. An electrical receptacle as claimed in claim 1 wherein said grounding strip has a screw receiving aperture therein, a wall plate mounted on top of said upper portion, and metallic screw means connecting said wall plate to said grounding strip for grounding said wall plate.

5. An electrical receptacle as claimed in claim 1 wherein a grounding strip receiving aperture is formed in said lower portion adjacent the underside of said mounting strap means and said portion of said grounding strip is threaded through said aperture for disposition under said mounting strap means.

6. An electrical receptacle as claimed in claim 1 wherein the upper and lower portions are ultrasonically joined after the grounding strip and contact elements have been placed therein.

7. An electrical receptacle as claimed in claim 1 wherein said lower portion has receptor contact elements in cavities in said lower portion.

8. An electrical receptacle as claimed in claim 7 wherein the receptor contact elements have contact element means separated by a joinder strip which can be severed after assembly to separate each contact element means into a separate circuit.

* * * * *